United States Patent [19]

Guenther

[11] 3,951,295

[45] Apr. 20, 1976

[54] TOP OPENING INSULATED TANK

[75] Inventor: Larry L. Guenther, Beatrice, Nebr.

[73] Assignee: Hoover Ball and Bearing Company, Saline, Mich.

[22] Filed: June 13, 1974

[21] Appl. No.: 479,047

[52] U.S. Cl. ..... 220/9 F; 220/63 R; 220/83; 220/357

[51] Int. Cl.[2] ..... B65D 25/18

[58] Field of Search ..... 220/9 R, 9 A, 9 F, 9 LG, 220/10, 83, 84, 357, 358, 63 R; 312/214

[56] References Cited

UNITED STATES PATENTS

| | | | |
|---|---|---|---|
| 1,810,615 | 6/1931 | Knight | 220/9 G |
| 2,106,840 | 2/1938 | Gould | 220/9 F |
| 2,216,830 | 10/1940 | Roberts | 220/9 F |
| 3,101,861 | 8/1963 | Mearns et al. | 220/10 |
| 3,194,622 | 7/1965 | Harter | 220/9 R |

FOREIGN PATENTS OR APPLICATIONS

| | | | |
|---|---|---|---|
| 1,005,500 | 9/1965 | United Kingdom | 220/9 LG |
| 1,934,662 | 4/1971 | Germany | 220/9 F |

*Primary Examiner*—William Price
*Assistant Examiner*—Stephen Marcus
*Attorney, Agent, or Firm*—Olsen and Stephenson

[57] ABSTRACT

An insulated container for maintaining the initial temperature of its contents for prolonged periods of time. Insulation, comprised of a polyethelene outer skin lamination, an intermediate expanded foam lamination, and a fluid tight polyethelene outer skin lamination, is attached to the inner surface of a rectangular tank having an inlet opening in the top wall. A gasket simultaneously provides a seal between the tank and a cover, a fluid tight covering over the juncture between the insulation and the tank at the inlet opening, and a fluid tight covering over the open edge of the insulation at the inlet opening.

3 Claims, 2 Drawing Figures

TOP OPENING INSULATED TANK

BACKGROUND OF THE INVENTION

This invention relates to an improved insulated container for the transportation and storage of such matter as fresh fish, where thermal insulation provides minimum heat transfer between the contents of the container and the outside atmosphere.

Fresh fish spoil easily while in transit from fishing vessels to processing plants or storage areas. Existing methods of refrigerated transportation are costly and ineffectual, and other types of insulated containers are bulky, inefficient, and expensive. Therefore, the desirability of an insulated container that is efficient, durable, compact, and easy to transport is acknowledged. It is an object of this invention, therefore, to provide an insulated container that maintains the initial temperature of its contents for prolonged periods of time, is readily transported and store, affords long service life, and is economical to manufacture.

SUMMARY OF THE INVENTION

In the unit of this invention a rectangular tank is formed of light metal such as aluminum with supporting legs located at the four corners of the bottom wall to facilitate handling of the container. Lifting lugs, located at the four corners of the top wall, are formed with a hole and a reinforced bushing to facilitate handling and provide stability when similar containers are stacked upon each other. An insulated lid is provided for the inlet opening of the container, thus preventing spillage of the contents and providing continuous insulating material over the inner surface of the tank. The insulation consists of a continuous body having three polyethelene laminations. The inner skin lamination is formed of impervious fluid tight polyethelene, the intermediate lamination consists of expanded foam polyethelene and provides the primary thermal insulating qualities, and the outer skin lamination is formed of polyethelene that is easily attached to the inner surface of the walls of the tank.

A gasket at the inlet opening of the container simultaneously provides a seal for the lid, a fluid tight covering over the juncture between the tank and the insulation, and a fluid tight covering over the outer edge of the insulation at the inlet opening.

Figure 1:
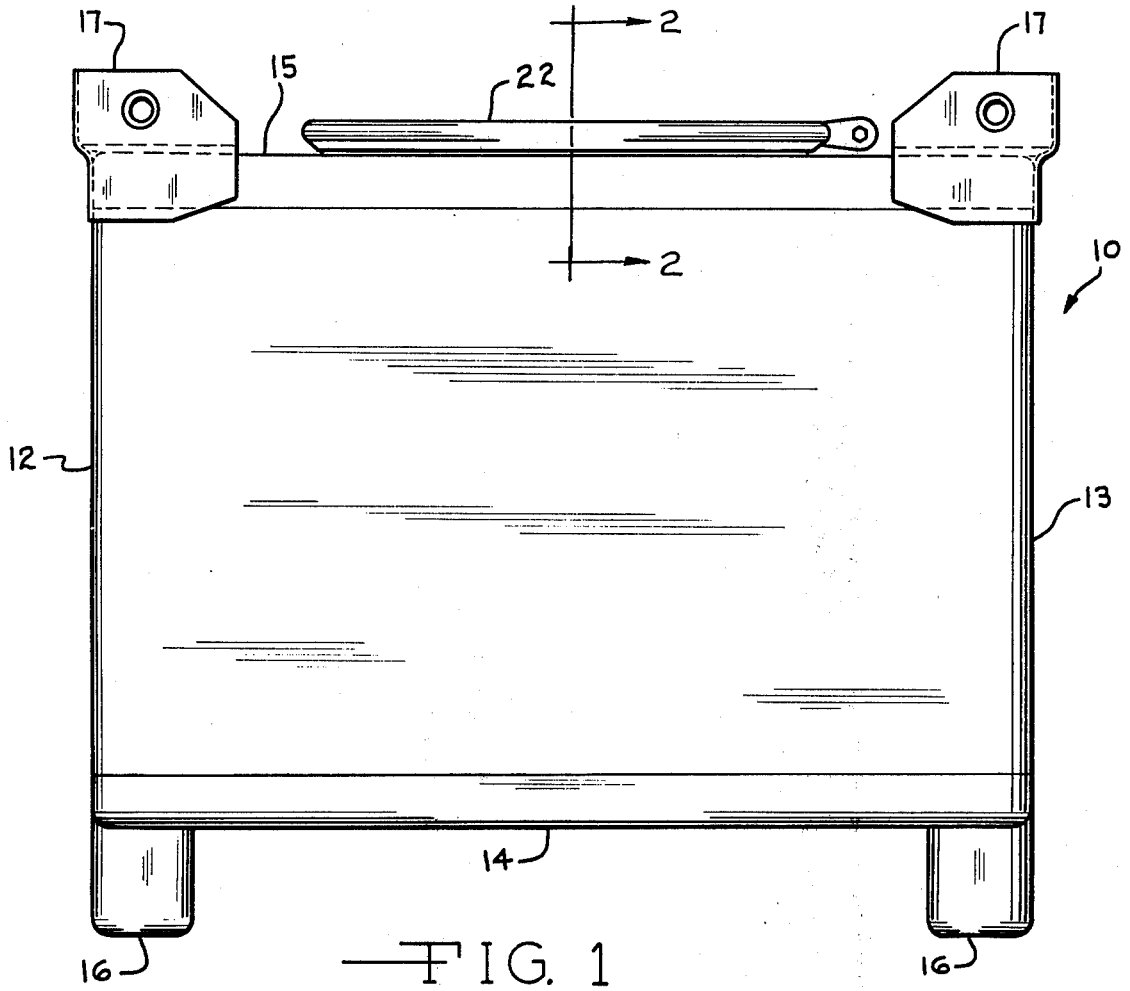
Figure 2:
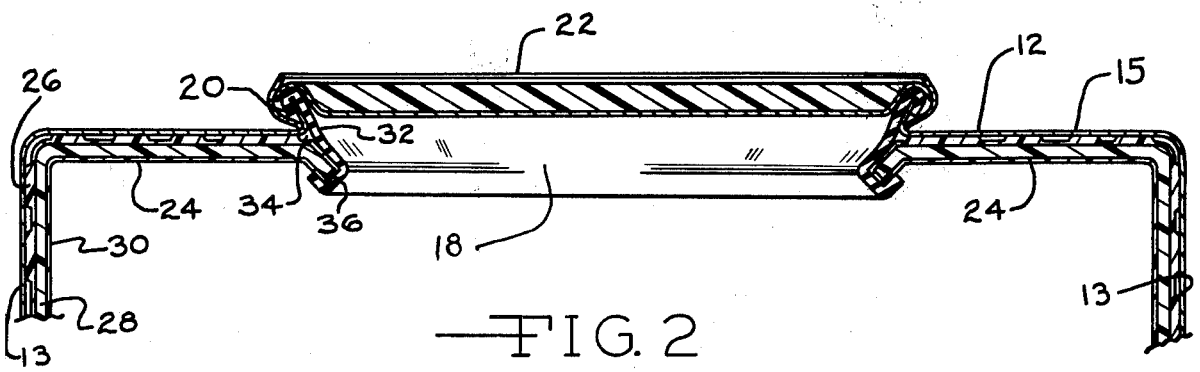

Further objects, features, and advantages of this invention will become apparent from a consideration of the following description, the appended claims and the accompanying drawing in which:

FIG. 1 is a front elevation view of the insulated container of this invention; and FIG. 2 is an enlarged fragmentary sectional view taken at line 2—2 in FIG. 1.

With reference to the drawing, the insulated tank or container of this invention, indicated generally at 10, is shown in FIGS. 1 and 2 as consisting of a rectangular tank 12, preferably formed of lightweight metal, having side walls 13, a bottom wall 14, and a top wall 15. Metal legs 16 attached to the four corners of the bottom wall enable easy handling of the container through such means as a forklift truck. Lifting lugs 17, located at the four corners of the top wall 15, enable the container to be lifted by such means as a hoist and also provide stability when several containers are stacked upon each other, thus allowing maximum utilization of transportation equipment and storage space by virtue of the rectangular shape of the tank 10. The top wall 15 of the tank has a combination inlet and discharge opening 18 bounded by an upturned flange 20 on the top wall 15 and normally closed by a lid 22.

A continuous body 24 of insulation is readily attached to the inner surface of the tank 12 as shown in FIG. 2. Three polyethelene laminations form the insulation body 24. The outer skin lamination 26 is formed so that it readily adheres to the inner surface of the tank 12. Primary thermal insulation is provided by an expanded foam intermediate lamination 28. A continuous fluid tight lamination 30 forms the inner skin of the insulation. This insulation 24 is designed to maintain the initial temperature of the contents of the container within a 10° F rise for 70 hours at 75° F ambient temperature.

A multipurpose gasket 32, as shown in FIG. 2, provides a seal between the lid 22 and the inlet opening flange 20, a fluid tight covering over the exposed edge 36 of the insulation body 24 at the inlet opening 18, and a fluid tight covering over the juncture 34 between the insulation 24 and the tank 12 at the inlet opening 18.

In the use of tank 10, material such as fresh fish along with water and ice are loaded into the tank 10 through the inlet-discharge opening. An insulated lid 22 is affixed to the inlet opening, thus providing a continuous insulating body 24 around the contents, and preventing spillage. The rectangular tank 10 is stacked along with other similar tanks by a forklift truck or a hoist utilizing the lifting lugs 17 onto transportation means such as a truck. The rectangular configuration of the container allows all available truck bed space to be utilized along with all permissible air space for storage during transportation. Upon reaching its destination, the tank 10 is either placed in cold storage until needed for processing, or taken directly to the processing area where the lid 22 is removed and the tank 10 is inverted discharging the fish for processing.

From the above description it is seen that this invention provides an improved insulated tank 10 which, by virtue of the attachment of a continuous insulating body 24 to the inner surface of a rectangular tank 12, maintains efficient thermal insulation. The continuous polyethelene insulating body 24, comprising an outer skin lamination 26 that readily attaches to a lightweight metal tank 12, an intermediate expanded foam lamination 28 that provides the primary thermal insulating qualities, and a continuous impervious inner skin lamination 30 that prevents the seepage of fluid into the expanded foam lamination thereby eliminating the possibility of contamination of the foam insulation 28, provides durable, efficient, and economical insulation. A gasket 32 simultaneously forms a seal with the lid 22, provides a fluid tight covering over the juncture 34 between the insulating body 24 and the tank 12 at the inlet opening 18, and provides a fluid tight covering over the open edge 36 of the insulating body 24 at the inlet opening 18. Attachment of this low cost polyethelene insulation 24 to the inner surface of a lightweight metal tank 12 provides efficient, low cost handling and storage of material required to be maintained at desired temperature levels.

It will be understood that the insulated container herein disclosed and described is presented for purposes of explanation and illustration and is not intended to indicate limits of the invention, the scope of which is defined by the following claims.

What is claimed is:

1. An insulated container comprising a rectangular tank having side walls, a bottom wall, and a top wall provided with an inlet opening, each of said walls having an inner surface and an outer surface, a continuous body of insulating material applied to the inner surface of said walls, said insulating materialf comprising three laminations, one lamination being substantially thicker than said walls, said one lamination being an expanded foam material having thermal insulating qualities, a continuous skin affixed to the outer side of said one lamination and securing said one lamination to said inner surface of said walls, and an inner lamination affixed to the inner side of said one lamination comprised of a continuous skin which is impervious to fluid, whereby said tank has a continuous fluid tight inner skin and is insulated so that it is capable of maintaining the initial temperature of the material stored in the tank over a prolonged period of time.

2. An insulated container according to claim 1 wherein said inlet opening is bounded by an upturned flange formed on said top wall, and wherein said insulating body has a downturned edge portion located below said flange, an annular gasket member having an upper edge portion mounted on said flange and a lower edge portion mounted on said edge portion of said insulating body, and a cover member mounted on said gasket so as to seal said opening.

3. An insulated container according to claim 2 wherein said gasket member is disposed in a covering relation with said edge portion of said insulating body to thereby provide a fluid tight covering for said edge portion.

* * * * *